United States Patent [19]

Schreiner et al.

[11] 4,000,434

[45] Dec. 28, 1976

[54] ROTARY ANODE FOR AN X-RAY TUBE

[75] Inventors: Horst Schreiner, Nurnberg; Ernst Geldner, Rosstal, both of Germany

[73] Assignee: Siemens Aktiengesellschaft, Munich, Germany

[22] Filed: June 12, 1975

[21] Appl. No.: 586,166

[30] Foreign Application Priority Data

June 24, 1974 Germany ..... 2430226

[52] U.S. Cl. ..... 313/330; 313/55

[51] Int. Cl.[2] ..... H01J 35/08

[58] Field of Search ..... 313/330, 55

[56] References Cited

UNITED STATES PATENTS

| | | | |
|---|---|---|---|
| 2,863,083 | 12/1958 | Schram | 313/330 |
| 3,790,838 | 2/1974 | Baum | 313/330 |
| 3,836,807 | 9/1974 | Schreiner et al. | 313/330 |
| 3,842,305 | 10/1974 | Braun | 313/330 |
| 3,869,634 | 3/1975 | Konieczynski et al. | 313/330 |

*Primary Examiner*—Saxfield Chatmon, Jr.
*Attorney, Agent, or Firm*—Kenyon & Kenyon Reilly Carr & Chapin

[57] ABSTRACT

A layered pressed and sintered anode body consisting of a support body of a tungsten-molybdenum alloy having a first layer of tungsten or tungsten alloy on the surface which is impinged by electrons and having a second layer of a higher melting point material on the other side whose tensile strength at the elastic limit is greater, at temperatures of 1400° to 1600° C, than the tensile stresses occurring at these temperatures to avoid warping of the anode.

4 Claims, 3 Drawing Figures

Fig. 3

ROTARY ANODE FOR AN X-RAY TUBE

BACKGROUND OF THE INVENTION

This invention relates to x-ray tubes in general and more particularly to an improved disc-shaped composite anode for use as a rotary anode in an x-ray tube.

Rotary anodes for x-ray tubes which consist of a layered, pressed and sintered anode body comprising a support body of a tungsten-molybdenum alloy with a first layer of tungsten or tungsten alloy on the surface which is impinged electrons, referred to as a spot track, and having on its opposite surface a second layer of a high melting point material are known.

For example, U.S. Pat. 2,863,083 teaches a rotary anode for x-ray tubes fabricated by the electro-deposition of several layers. The anode comprises a support body of molybdenum partially covered with the intermediate layer of tungsten. On the intermediate layer an x-ray active layer of rhenium is placed. With a design of this nature the cooling down speed of the anode is supposedly increased considerably.

In addition, a disc shaped composite anode for use as a rotary anode for x-ray tubes and comrising a layered, pressed, and sintered anode body of a high melting point material in which at least the surface layer which is impinged by electrons is an x-ray active layer of a tungsten alloy is known. To prevent formation of cracks in the anode body even with high loads two further layers are provided beneath the x-ray active first layer. The second layer consists of pure tungsten of tungsten alloy with a high tungsten content of at least 70% tungsten and a third layer beneath that consists of a molybdenum alloy.

In practice, it has been discovered that an anode disc of this nature warps even after a short period of operational use. Specifically, the anode angles which were originally 10° to 20° changed to 8° or less. As a result image quality is degraded and in extreme cases the rotary anode becomes useless.

Tests have shown that with a cold start i.e. where an anode cooled down to room temperature is suddenly loaded, as well as with a hot start where the anode is already at a uniform background temperature of e.g. 700°, loading times of 5–10 seconds or 2–20 seconds respectively normally produce stresses at a depth of 1 mm from the surface of the rotary anode, for example, which exceed the elastic limit of the material. In the case of a hot start such conditions can prevail to a depth of even 5–6 mm. This corresponds to approximately the entire thickness of the rotary anode.

This warping of the anode discs causing their angles to be decreased can be understood from the fact that in operation the thermal expansion of the relatively heat resistant x-ray active layer of a tungsten alloy, for example, forces elongation of the support body, which may consist of a tungsten-molybdenum alloy, beyond its elastic limit because of the temperature distribution. This plastic deformation at temperatures above 1400° C is not reversible during cooling down. As a result the angle becomes smaller with increasing operating time. The process takes place in small steps but eventually leads to intolerably large angle changes and in an extreme case continues until the anode becomes flat.

Various measures are known for increasing the stability of the support body. For example it is known that it can be done by increasing the cross-section or through the use of ribs. However, these methods provide only a slight improvement of the angular stability. Furthermore, such can be obtained only if the cross sections are substantially increased or the ribs brought out of the solid body for a relatively large distance. Either of these solutions is accompanied by a considerable increase in weight and, in the case of a ribbed design, by more wear on drop forge dies used in making the anodes. This leads to an undesirable increase in the cost of the rotary anode. Furthermore, a more powerful drive and more expensive bearings for the rotary anode are required.

In view of these problems with prior art anodes, the need for an improved rotary x-ray anode in which no warping takes place even under high loads becomes evident.

SUMMARY OF THE INVENTION

The present invention solves this problem by providing, as the second layer in an anode such as that described above, a material whose tensile strength at the elastic limit is greater at temperatures of 1400° to 1600° C than the tensile stresses occurring at these temperatures. Preferably the thickness of the second layer is made to be 0.7 mm for each kw of electron beam power. An advantageous material for use in the second layer is a tungsten alloy containing alone or in combination niobium, tantalum, zirconium, hafium, rhenium and/or ruthenium.

DETAILED DESCRIPTION OF THE PREFERRED EMBODIMENT

Figure 1:
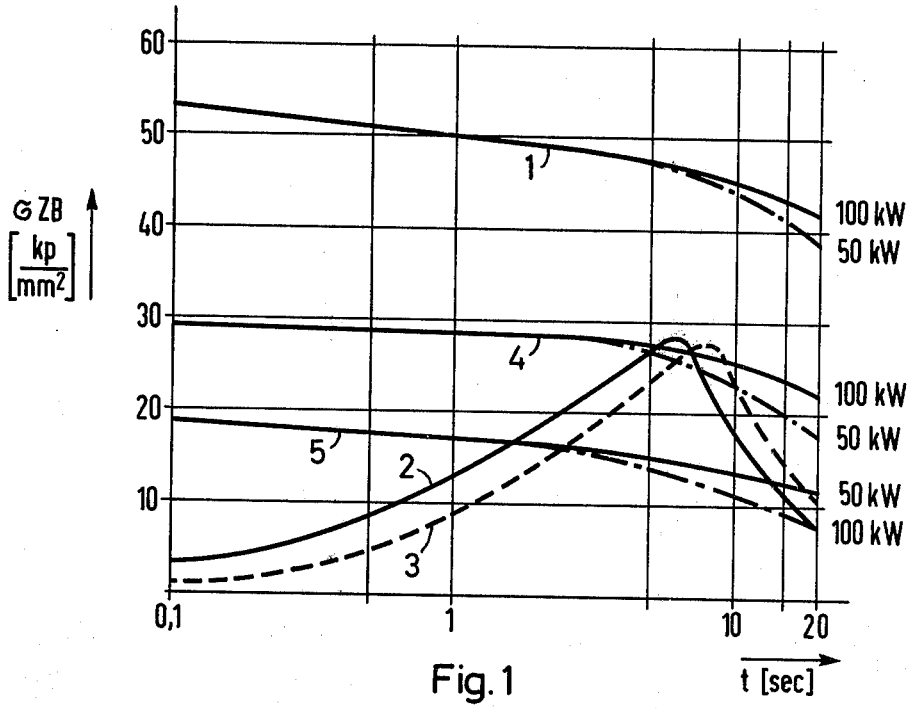
FIGS. 1 and 2 are graphs illustrating the dependence of the ultimate tensile strength of the materials as a function of the load application time and nominal power.
Figure 2:
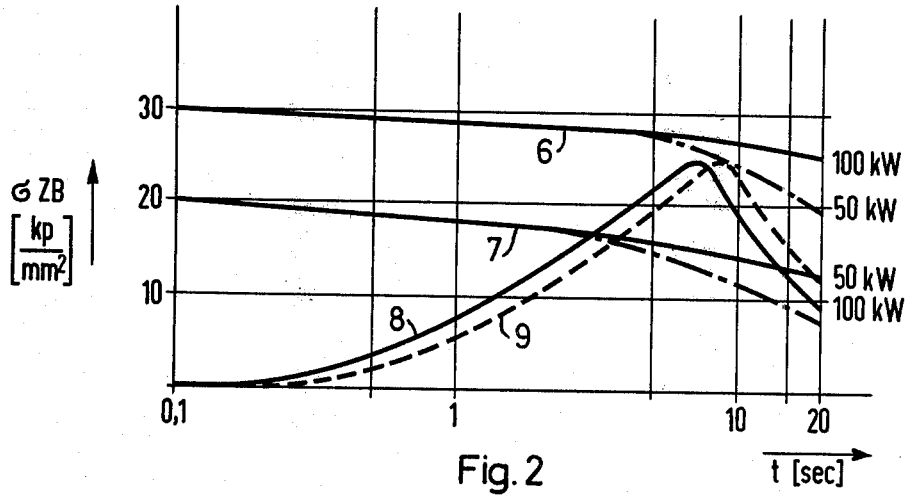

FIG. 1 and 2 illustrate thermal stresses at depths of 1 and 6 mm [at 5 mm in the case of the 50 kw anode] as a function of loading time $t$. For purposes of direct comparison corresponding ultimate tensile strengths $\sigma_{ZB}$ of the materials are shown in kg/mm$^2$. Curve 1 of FIG. 1 illustrates that the strength values for a tungsten-rhenium alloy is definitely above the tensile stresses which actually occur in the anode body and the shape of which is illustrated by curves 2 or 3. The tungsten-rhenium alloy is, for example, the track which is impinged by the electrons. Curves 2 and 3 are valid even in the case of a hot start, i.e., 700° C background temperature. Curve 2 is for a nominal power of 100 kw and curve 3 for a nominal power of 50 kw. The large difference between the actual magnitude of the stress in the range of about 6 to 8 seconds loading time up to the corresponding ultimate breaking strength, which is extrapolated from the tensile tests performed, illustrates the superior strength of the tungsten-rhenium alloy. The stresses which actually occur in the anode are thus still within the range of validity of Hooke's Law and do not result in a plastic deformation.

In the layer below this layer on which the electrons impinge and which is made of a molybdenum-tungsten alloy, the situation is different. FIG. 1 illustrates with curve 4 the actual thermal stresses of the anode for a cold start. As illustrated, the thermal stresses of the anode can reach a value which exceeds the ultimate hot tensile strength even at a depth of 1 mm in the loading range of about 6 to 8 sec. This depth, in conventional anode discs, is the transition zone between the tungsten-rhenium layer and the molybdenum-tungsten layer. The case of a hot start is illustrated by curve 5. As is clear, the situation here is even more unfavorable. The critical loading range increases now covering the period from 2 to 19 secs. In the above mentioned loading ranges the molybdenum-tungsten layer acts only as a heat sink. Its additional function of strengthening the tungsten-rhenium layer is no longer performed.

In this range of loading times the molybdenum-tungsten layer initially follows the thermal expansion of tungsten-rhenium layer through elastic deformation. Once the elastic limit is reached plastic deformation takes place. When cooling down again the plastic deformation of the molybdenum-tungsten layer remains. This results in a change in the original angles of the electron tracks in the direction towards smaller values. Curves 6 and 7 of FIG. 2 illustrate the shape of the ultimate tensile strengths of the molybdenum-tungsten alloy for cold and hot starts as a function of the loading time and nominal power. Curves 8 and 9 of FIG. 2 illustrate the shape of the tensile stresses as a function of loading times and nominal power. It is evident that similar conditions apply in the lower layers in this case also.

Figure 3:
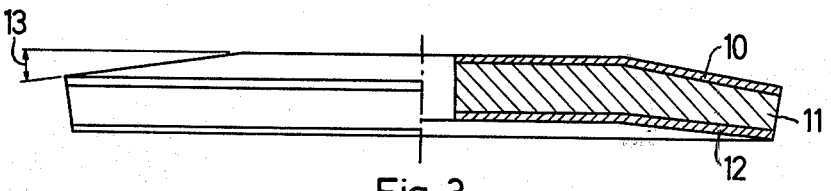
FIG. 3 is an elevation view, partially in cross section, of a rotary anode according to the present invention.

FIG. 3 illustrates a rotary x-ray anode according to the present invention. Shown is a support body 11 having an active layer of tungsten or tungsten alloy 10 on one side. The support body itself is made of a tungsten-molybdenum alloy. A second layer 12 of a tungsten alloy is placed on the other side of the anode in accordance with the present invention. The angle 13 is the anode angle which is to be maintained under even stress. The following are examples of anodes constructed in accordance with the present invention.

EXAMPLE 1

In this example the surface layer 10 which is impinged by the electrons consists of a tungsten-rhenium alloy containing 10% by weight of rhenium. The layer is 1 mm thick. The support body 11 therebelow which also serves as a heat sink consists of a molybdenum alloy with 5% by weight of tungsten and is 4 mm thick. A layer 12 following the support body and which in accordance with the present invention prevents the overall anode disc from warping consists of a tungsten alloy containing 5% by weight of tantalum and is 2 mm thick.

EXAMPLE 2

In this example the x-ray active layer 10 and support body 11 have the same structure as in Example 1. However, the layer 12 consists of a tungsten alloy with 20% by weight of niobium.

EXAMPLE 3

In this example the x-ray active layer consists of a tungsten alloy with 5% by weight of niobium and is 2 mm thick. The support body consists of a molybdenum alloy with 5% by weight of niobium and is 10 mm thick. Layer 12 consists of a tungsten alloy with 5% by weight of hafnium and 1% by weight of zirconium and is 3 mm thick.

Thus, an improved x-ray anode in which a strengthening layer to prevent warping is provided has been shown.

Although specific examples have been illustrated and described, it will be obvious to those skilled in the art that various modifications can be made without departing from the spirit of the invention which is intended to be limited solely by the appended claims.

What is claimed is:

1. A disc-shaped composite anode for use as a rotary anode in an x-ray tube, said anode comprising a layered, pressed and sintered anode body comprising:

a. a support body consisting of a tungsten-molybdenum alloy;

b. a first layer of one of the group consisting of tungsten and a tungsten alloy on one side of said support body forming a surface to be impinged by electrons;

c. a second layer consisting of a tungsten alloy containing at least one of the group consisting of niobium, tantalum, zirconium, hafnium, rhenium and ruthenium on the opposite side of said support body said second layer having a thickness which is 0.7 mm for each 50 kw of electron beam power.

2. A composite alloy according to claim 1 wherein said support body consists of a molybdenum alloy with 5% by weight of tungsten and is 4 mm thick, said x-ray active first layer consists of a tungsten-rhenium alloy with 10 percent by weight of rhenium and is 1 mm thick and said second layer consists of a tungsten alloy with 5% by weight of tantalum and is 2 mm thick.

3. A composite anode according to claim 1 wherein said support body consists of a molybdenum alloy with 5% by weight of tungsten and is 4 mm thick, said x-ray active first layer consists of a tungsten-rhenium alloy with 10% by weight of rhenium and is 1 mm thick, and said second layer is a tungsten alloy with 20% by weight of tantalum and is 2 mm thick.

4. A composite anode according to claim 1 wherein said support body consists of a molybdenum alloy with 5% by weight of niobium and is 10 mm thick, said x-ray active first layer consists of a tungsten alloy with 5% by weight of niobium and is 2 mm thick, and said second layer is a tungsten alloy with 5% by weight of hafnium and 1% by weight of zirconium, and is 3 mm thick.

* * * * *